United States Patent [19]

Müller

[11] 4,237,569

[45] Dec. 9, 1980

[54] BOOKBINDING MACHINE

[75] Inventor: Hans Müller, Zofingen, Switzerland

[73] Assignee: Grapha-Holding AG, Hergiswil, Switzerland

[21] Appl. No.: 24,654

[22] PCT Filed: Feb. 21, 1979

[86] PCT No.: PCT/CH78/00009

§ 371 Date: Mar. 19, 1979

§ 102(e) Date: Feb. 21, 1979

[87] PCT Pub. No.: WO 79/00049

PCT Pub. Date: Feb. 8, 1979

[30] Foreign Application Priority Data

Jul. 19, 1977 [CH] Switzerland ..... 8909/77

[51] Int. Cl.[3] ..... B42C 13/00

[52] U.S. Cl. ..... 11/3

[58] Field of Search ..... 11/1 R, 2, 3, 4

[56] References Cited

U.S. PATENT DOCUMENTS

| | | | |
|---|---|---|---|
| 493,959 | 3/1893 | Arnold | 11/4 |
| 1,085,888 | 2/1914 | Bredenberg | 11/4 |
| 1,088,932 | 3/1914 | Ritchie | 11/4 |

FOREIGN PATENT DOCUMENTS

| | | | |
|---|---|---|---|
| 1207334 | 12/1965 | Fed. Rep. of Germany | 11/4 |
| 325096 | 12/1957 | Switzerland | 11/3 |

*Primary Examiner*—Paul A. Bell

*Attorney, Agent, or Firm*—Peter K. Kontler

[57] ABSTRACT

Bookbinding machine with a horizontal turntable 2 which carries pairs of clamping jaws (3, 4) and transports the pairs of clamping jaws past work stations (A–E), wherein a disc cam (16) is provided coaxially with the turntable to open and close the pairs of clamping jaws, characterized in that the axis of the turntable is defined by a shaft (13) which is rotatably connected with the turntable by friction elements (11, 14, 15), that the shaft is non-rotatably connected with a second disc cam (44) which controls the movements of a restrainer (40) into and/or from the path of the turntable in order to arrest briefly the turntable whenever a pair of clamping jaws is located at the inserting station (A) for inner books.

9 Claims, 2 Drawing Figures

BOOKBINDING MACHINE

BACKGROUND OF THE INVENTION

The present invention relates to a bookbinding machine wherein a horizontal turntable carries pairs of clamping jaws and transports the jaws past work stations, and wherein a disc cam is provided coaxially with the turntable to open and close the pairs of clamping jaws.

Such bookbinding machines are known and are described, for example, in Swiss Pat. No. 325,096. They exhibit the advantage that they operate continuously and at high speeds. However, they are not suited for mere occasional production of small book editions owing to the large structural outlay and the associated high costs.

OBJECT AND SUMMARY OF THE INVENTION

An object of the present invention is a simplification of the aforementioned machine in such a way that it is economically suitable for the production of small book editions.

In accordance with the invention, this object is accomplished in that the axis of the turntable is defined by a shaft to which the turntable is rotatably connected by friction generating means and in, that the shaft is non-rotatably connected with a second disc cam which controls the movements of a restrainer into and/or out of the path of the turntable for the purpose of briefly arresting the turntable whenever a pair of clamping jaws is located at the inserting station for the inner books.

The invention will be explained by way of example with reference to the accompanying schematic drawing.

DESCRIPTION OF THE PREFERRED EMBODIMENTS

Figure 2:
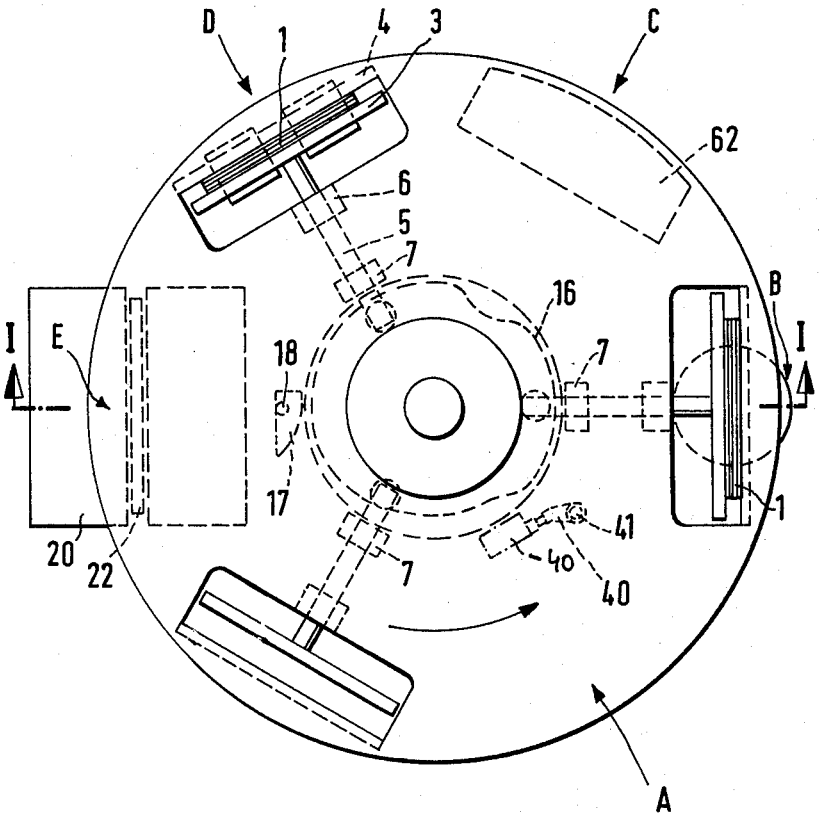

An upright shaft 13 which is rotatably mounted in a machine frame 49 carries a freely rotatable turntable 2 which comprises three normally closed openable gripping devices in the form of pairs of clamping jaws 3, 4 staggered at 120° around the shaft 13. When the turntable 2 rotates in the direction of arrow shown in FIG. 2, the pairs of clamping jaws 3, 4 are transported past work stations A, B, C, D and E. A cap 12 is screwed onto the shaft 13. A prestressed helical compression spring 14 is disposed between the cap 12 and a coupling dish 15 which is connected with the shaft 13. The coupling dish 15 is non-rotatably secured to and is movable axially of the shaft 13 so that it is biased against the turntable 2 under the action of the helical spring 14. A ring-shaped friction generating element 11 is disposed between the coupling dish 15 and the turntable 2 so that the rotating coupling dish 15 entrains the turntable 2. However, the turntable 2 can be arrested, while the coupling dish 15 or the shaft 13 rotates, against the action of the force which is generated by the element 11.

The shaft 13 is driven by a motor 48 which is secured to the machine frame 49. A friction wheel 50 which is non-rotatably mounted at one end of the shaft of the motor 48 drives, by way of a friction wheel 51, a friction wheel 57 which is mounted on and is free to rotate with respect to the shaft 13. The friction wheel 57 is rigidly connected with a pinion 58 which meshes with a pinion 54. The pinion 54 is non-rotatably secured to one end of a shaft which is rotatably mounted in the machine frame 49 and the other end of which carries a pinion 55 meshing with a gear 59. The gear 59 is non-rotatably connected with the shaft 13.

The friction wheel 51 is mounted on and is free to rotate with respect to a shaft 52 which, in turn, is secured to an end 53 of a lever 60. The lever 60 is mounted on and is free to pivot relative to the shaft 13. The free end of the lever 60 projects outwardly through a slot in the machine frame 49 and can be pivoted about the shaft 13 by hand or by foot. Such pivotal movement brings the friction wheel 51 in physical contact with or disengages it from the friction wheels 50 and 57 so that the operative connection between the motor 48 and shaft 13 can be interrupted by the step down friction wheel transmission 50, 51, 52, 53, 57.

For the opening and closing of the pairs of clamping jaws 3 and 4, a stationary first disc cam 16 is fixedly connected to the machine frame 49 coaxially with the shaft 13. The inner clamping jaw 3 of each pair of clamping jaws 3, 4 is longitudinally slidably mounted on the turntable 2 by means of a guide rod 5 which is reciprocable in bearings 6 and 7 and is biased against the outer clamping jaw 4 under the action of a prestressed helical compression spring 10. A discrete cam follower roller 8 is rotatably mounted on each thrust rod 5, as at 9, and tracks the cam 16. The cam 16 is configurated in such a way that the pairs of clamping jaws 3 and 4 are opened for a predetermined interval of time at selected work stations, namely, at the inserting station A for inner books, at the lowering station C and at the combined cover applying and book removing station E. A second disc cam 44 which is non-rotatably secured to the shaft 13 actuates a lever 42 by way of a cam follower roller 43. The lever 42 is pivotably mounted in the machine frame 49 by way of a shaft 41. A restrainer in the form of a stop 40 which is pivotable between two end positions is secured to the upper end of the shaft 41. In one of its end positions, the stop 40 extends into the path of movement of bearings 7 on the turntable 2 and intercepts and arrests the oncoming bearing 7 and hence the turntable 2; in the other end position, the stop 40 releases the turntable 2 so that the latter 2 shares the rotary movement of the shaft 13. The disc cam 44 is configurated in such a way that the stop 40 extends into the path of movement of a bearing 7 when the corresponding pair of clamping jaws 3, 4 is located at the inserting station A for the stacks of overlapping sheets which constitute the inner books. Since the working stations A, C and E as well as the three pairs of clamping jaws 3, 4 are angularly offset with respect to each other by 120°, a pair of clamping jaws 3, 4 is always located at each of the working stations C and E when a third pair of clamping jaws 3, 4 is located at the inserting station A for the inner books.

Furthermore, a third disc cam 45 is non-rotatably attached to the shaft 13. This cam cooperates with a cam follower roller 39 mounted on a lever 38 which is secured to a shaft 18. The shaft 18 is rotatably mounted in the machine frame 49 and its upper end carries a lever 17. The disc cam 45 is configurated in such a way that, when a pair of clamping jaws 3, 4 is located at the work station E, the clamping jaws 3, 4 are opened as a result of pivoting of the linking including the lever 17 as soon as a book cover 19 is pressed against the spine of the inner book. The book 1 thereupon descends into the receptacle 29. To this end, the lever 17 is pivoted in a counterclockwise direction, as viewed in FIG. 2, so that it pushes the cam follower roller 8 of a pair of clamping jaws 3, 4 inwardly against the action of the helical spring 10 whereby the guide rod 5 is moved axially toward the shaft 13 and the pair of clamping jaws 3, 4 opens.

Figure 1:
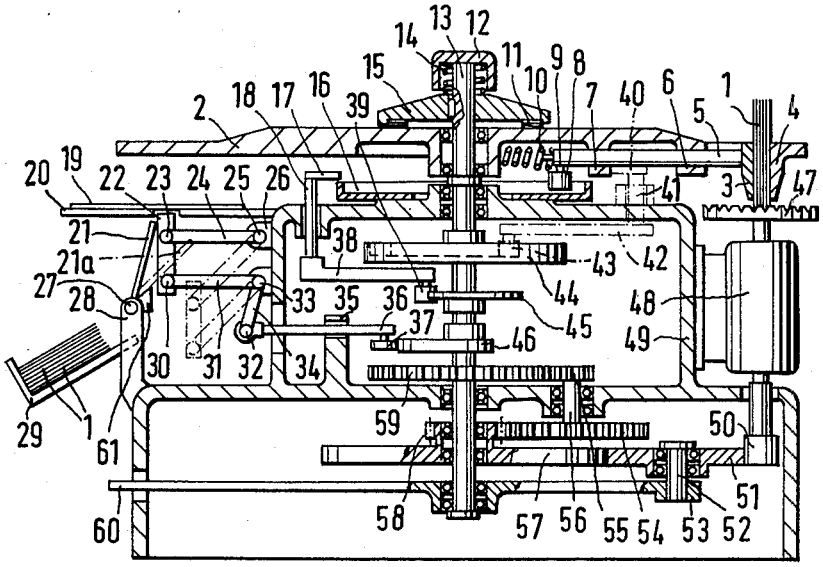
FIG. 1 is a vertical sectional view of a bookbinding machine as seen from the line I—I of FIG. 2, and FIG. 2 a plan view of the bookbinding machine which is shown in FIG. 1.

A fourth disc cam 46 is non-rotatably attached to the shaft 13 at a level below the disc cam 45. The cam 46 cooperates with a cam follower roller 37 which is rotatably mounted at one end of a thrust rod 36. The thrust rod 36 is axially movably mounted in a bearing 35 which is fixedly secured to the machine frame 49, and the other end of the thrust rod 36 carries a pivot 32 articulately connected with a bell crank lever 31, 34 which is pivotably mounted on a bearing 26 of the machine frame 49, as at 33. The arm 31 of the bell crank lever 31, 34 constitutes a portion of a parallelogram linkage consisting of pivot bearings 23, 25, 30 and 33 as well as levers 24, 31 and a pressing element 22. The pressing element 22 is displaceable between the end positions shown in FIG. 1 by solid and phantom lines. In the first (solid-line) end position, the pressing element 22 urges a cover sheet 19 which is located on a feed table 20 against the adhesive-coated spine of the inner book (not shown in the drawing) which is located thereabove.

A shaft 27, to which there is secured a flap 21, is likewise rotatably mounted in bearings 28 on the machine frame 49. In its end position which is shown by solid lines, the flap 21 abuts against the pressing element 22. In an end position 21a which is shown by phantom lines, the flap 21 abuts against a stop 61 on the bearings 28. The flap 21 is pivoted between the two end positions as a result of upward and downward movement of the pressing element 22.

When a pair of clamping jaws 3, 4 is located at the work station A, such pair of clamping jaws 3, 4 is open owing to the configuration of the disc cam 16. At the same time, owing to the configuration of the disc cam 44, the stop 40 extends into the path of movement of the bearing 7 so that the turntable 2 is arrested even though the shaft 13 continues to rotate. At the same time, another pair of clamping jaws 3, 4 is located at each of the work stations C and E. An inner book 1 is manually inserted into the pair of clamping jaws 3, 4 which is located at the work station A so that the spine of the book 1 rests on a table, not shown. The stop 40 is thereupon withdrawn from the path of rotary movement of the bearing 7 so that the turntable 2 is free to rotate. Once the turntable 2 has been set in rotary motion, the pair of clamping jaws 3, 4 closes and moves the inner book 1 which is clamped therebetween beyond past the trimming station B where the spine of the inner book 1 is trimmed by a milling tool 47 which is driven by the motor 48 so that the trimmed inner book 1 projects only slightly downwardly beyond the clamping jaws 3 and 4. The turntable 2 is arrested as soon as the pair of clamping jaws 3, 4, with an inner book 1 having a trimmed spine, reaches and stops at the work station C because the bearing 7 of the next-following pair of clamping jaws 3, 4 engages the stop 40. At the work station C, the clamping jaws 3, 4 are opened and the inner book 1 is lowered onto a horizontal table 62 which is located therebelow and whose upper surface is located in a plane which is tangential to adhesive-applying rolls of the next-following adhesive applying station D. As soon as the stop 40 releases the next-following pair of clamping jaws 3, 4, the turntable 2 resumes its rotation and the inner book 1 is moved past the work station D at which the spine of the book 1 is coated with adhesive by the adhesive-applying rolls. The turntable 2 is arrested again as soon as the pair of clamping jaws 3, 4 reaches the work station E because the bearing 7 of the third pair of clamping jaws engages the stop 40. A cover sheet 9 has been previously placed by hand onto the feed table 20 of the work station E. The disc cam 46 thereupon moves the pressing element 22 upwardly until the latter presses the cover sheet 19 against the adhesive-coated spine of the inner book 1. When the cover sheet 9 adheres to the spine of the inner book 1, the pressing element 22 is lowered and the flap 21 pivots to the position **21*a*. In such position 21*a* of the flap 21, the disc cam 45 pivots the lever 17 which moves the inner clamping jaw 3 away from the outer clamping jaw 4 via cam follower roller 8 and the finished book 1 is released so that it descends onto the flap 21 and slides off the flap 21 into the receptacle 29**.

The stop 40 thereupon again releases the turntable 2. The pair of clamping jaws 3, 4 is again advanced to the work station A to be arrested by the stop 40 and to be ready for reception of a further inner book 1. The aforementioned cycle is then repeated.

I claim:

1. In a machine for attaching covers to stacks of overlapping sheets, the combination of a shaft; means for rotating said shaft; a turntable rotatably mounted on said shaft; entraining means interposed between said turntable and said shaft for normally rotating said turntable in response to rotation of said shaft, including first and second elements respectively affixed to said shaft and to said turntable and engaging one another only by friction; a plurality of normally closed openable gripping devices mounted on said turntable and spaced apart from each other, as considered in the circumferential direction of said shaft; a book inserting station adjacent to the path of movement of said devices; means for opening successive gripping devices at said inserting station, including first cam means and discrete first follower means each associated with one of said gripping devices and tracking said cam means; and means for arresting said turntable whenever one of said gripping devices is located at said inserting station, including second cam means rotatable with said shaft and second follower means tracking said second cam means and arranged to intercept said turntable with attendant overcoming of the friction between said first and second elements of said entraining means whenever one of said gripping devices reaches said station whereby said turntable is temporarily held against rotation with said shaft to allow for insertion of a stack into the open gripping device at said station.

2. The combination of claim 1, further comprising a second station adjacent to said path and spaced apart from said inserting station, as considered in the circumferential direction of said shaft, the spacing between said gripping devices being such that another of said gripping devices is located at said second station whenever said one gripping device is located at said inserting station.

3. The combination of claim 1, further comprising a cover-applying station adjacent to said path and spaced apart from said first mentioned stations, as considered in the circumferential direction of said shaft, the spacing between said gripping devices being such that still another of said gripping devices is located at said cover applying station whenever said one gripping device is located at said inserting station.

4. The combination of claim 3, further comprising means for receiving stacks and the applied covers from successive gripping devices at said cover applying station.

5. The combination of claim 1, further comprising a stack removing station adjacent to said path and spaced apart from said inserting station, as considered in the circumferential direction of said shaft, and means for opening successive gripping devices at said removing station including third cam means rotatable with said shaft, third follower means tracking said third cam means, and a linkage receiving motion from said third follower means and operative to open successive gripping devices arriving at said removing station.

6. The combination of claim 1, further comprising a cover-applying station adjacent to said path and spaced apart from said inserting station, as considered in the circumferential direction of said shaft, the spacing between said gripping devices being such that another of said gripping devices is located at said cover applying station whenever said one gripping device is located at said inserting station, a pressing element located at said cover applying station and movable into and from engagement with a cover which is applied to the stack of sheets in the gripping device at said cover-applying station, and means for moving said pressing element into engagement with the applied cover at said cover applying station including further cam means rotatable with said shaft, further follower means tracking said further cam means and a linkage connecting said further follower means with said pressing element.

7. The combination of claim 1, wherein said rotating means comprises a motor and a step-down transmission interposed between said motor and said shaft.

8. The combination of claim 7, wherein said step-down transmission comprises a friction wheel transmission.

9. The combination of claim 1, further comprising a second station adjacent to said path and spaced apart from said inserting station, as considered in the circumferential direction of said shaft, the spacing between said gripping devices being such that another of said gripping devices is located at said second station whenever said one gripping device is located at said inserting station, and a rotary tool adjacent to said second station and arranged to remove material from the stack in the gripping device at said second station, said tool receiving torque from said rotating means.

* * * * *